US006406380B1

(12) United States Patent
Jackson

(10) Patent No.: US 6,406,380 B1
(45) Date of Patent: Jun. 18, 2002

(54) GOLF PUTTER CLUBHEAD

(76) Inventor: Robert E. Jackson, 1368 City View Dr., Bend, OR (US) 97701

( * ) Notice: Subject to any disclaimer, the term of this patent is extended or adjusted under 35 U.S.C. 154(b) by 0 days.

(21) Appl. No.: 09/261,057

(22) Filed: Mar. 2, 1999

Related U.S. Application Data

(60) Provisional application No. 60/089,272, filed on Jun. 15, 1998.

(51) Int. Cl.[7] ..... A63B 53/04; A63B 53/06; A63B 53/08

(52) U.S. Cl. ..... 473/340; 473/330; 473/255; 473/251

(58) Field of Search ..... 473/255, 251, 473/330, 340, 313

(56) References Cited

U.S. PATENT DOCUMENTS

| | | | | |
|---|---|---|---|---|
| 1,674,173 A | * | 3/1928 | Haupt | 473/249 |
| 3,758,115 A | | 9/1973 | Hoglund | |
| 4,290,606 A | * | 9/1981 | Maxwell | 473/249 |
| 4,871,174 A | * | 10/1989 | Kobayashi | 273/164 |
| 5,078,398 A | * | 1/1992 | Reed et al. | 273/80 A |
| 5,344,149 A | * | 9/1994 | Miller | 273/167 |
| 5,890,969 A | * | 4/1999 | Bechler | 473/255 |
| 6,045,452 A | * | 4/2000 | Ahn et al. | 473/249 |

FOREIGN PATENT DOCUMENTS

| | | |
|---|---|---|
| JP | 59-12916 | 4/1984 |

* cited by examiner

*Primary Examiner*—Paul T. Sewell
*Assistant Examiner*—Sneh Varma
(74) *Attorney, Agent, or Firm*—ipsolan llp

(57) ABSTRACT

A unique golf putter clubhead, when attached to a shaft, assures better directional control of a golf ball travel when use for its primary purpose of putting a golf ball. The putter clubhead is formed along a longitudinal axis generally transverse to the plane defined by the ball-striking face. The ball-striking face may be formed in a radial surface defining either a spherical or cylindrical arc.

17 Claims, 1 Drawing Sheet

GOLF PUTTER CLUBHEAD

REFERENCE TO RELATED APPLICATIONS

This application claims the benefit of U.S. Provisional Application No. 60/089272, filed Jun. 15, 1998.

FIELD OF THE INVENTION

This invention relates to golf clubs, and more specifically to a golf putter having an improved design for improved putting accuracy.

BACKGROUND OF THE INVENTION

It is an accepted fact that in the game of golf, putting of the ball, either on or off the green, requires a shorter more controllable stroke or swing than other golf shots. A shorter, more controlled swing helps to assure more accuracy and controlled contact with the ball, which in turn increases accuracy of the shot and decreases the likelihood of a mis-hit. It is also true that putting is one of the single most important aspects of the game, and that missed puts can add significantly to a player's score. Therefore, improvements in a player's putting game can be a significant part of lowering overall scores.

In view of the greater control of the club during the putting stroke, this invention reduces the size of the ball striking face of a putter to preferably about the diameter of a typical golf ball. The putter of the present invention also concentrates the center of mass of the clubhead on the cylindrical axis of the clubhead, centered on the ball striking face, thereby reducing the probability of mis-hitting the ball and resulting in improved directional control of ball travel.

DESCRIPTION OF THE PREFERRED EMBODIMENTS

Figure 1:
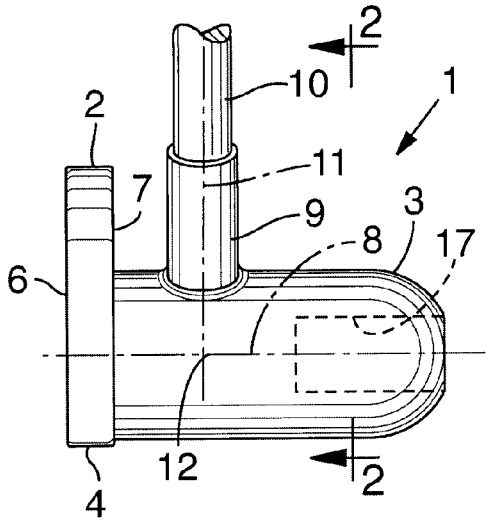
FIG. 1 is a side elevational view of the clubhead showing a preferred position of the shaft neck above the center of mass of the clubhead.

A golf putter clubhead 1 according to the present invention is shown in FIG. 1. Putter clubhead 1 includes a putter body having two principal body sections, a forward-facing ball-striking plate 2 and a rearward-extending tail portion 3. As may be seen in FIG. 2, the forward-facing ball-striking plate 2 is semi-circular. A sole 4 is formed on the lowermost periphery of ball striking plate 2 in such a position that the plane of the sole lies parallel to the turf 5 when the putter is in the normal position for striking the ball. That is, sole 4 is a flattened or beveled section formed on the lowermost periphery of the ball striking plate that allows for a smooth putting stroke without effecting the symmetry or concentricity of the clubhead, as described below. Sole 4 defines either a right-handed or a left-handed club. The forward-facing surface of ball-striking plate 2 is that portion of the putter that is presented to the golf ball when the clubhead actually makes contact with the golf ball, and is labeled with reference number 6. The rearward-facing surface 7 of the ball-striking plate 2 is opposite the forward-facing surface.

As used herein, forward is the direction that a golf ball travels relative to the putter when the ball is stroked.

Tail portion 3 of clubhead 1 extends from the rearward-facing surface 7 of ball-striking plate 2. Tail portion 3 is preferentially cylindrical in cross sectional shape and defines a longitudinal axis 8 extending along the length of the tail portion generally transverse to the plane of the ball-striking plate. In FIG. 1, the entire forward-facing surface 6 of ball striking plate 2 is planar and defines a plane that is substantially normal to longitudinal axis 8. A neck 9 for attachment of a club shaft 10 is formed on the tail portion and defines a neck axis 11. Neck axis 11 is normal to and radiates from longitudinal axis 8 through tail portion 3. Clubhead 1 has a center of mass 12 that preferably lies on and is coincident with longitudinal axis 8. Preferably, neck axis 11 intersects longitudinal axis 8 at the center of mass 12 of the clubhead 1.

Figure 2:
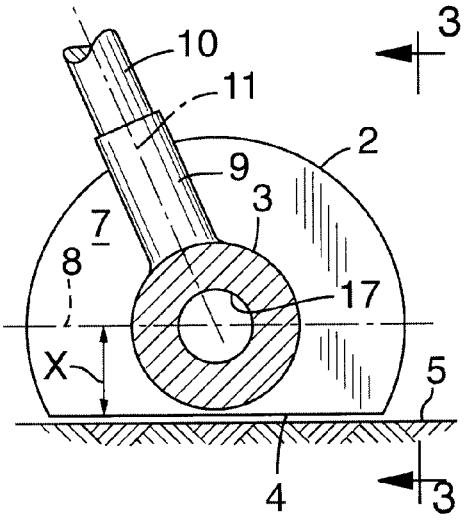
FIG. 2 is a sectional view of the clubhead taken along the line 2—2 of FIG. 1, rotated about the longitudinal axis through the clubhead, and showing the symmetry and concentricity of the head with the cylindrical axis through the clubhead and the radial alignment of the neck axis with the clubhead axis.

With reference to FIG. 2 it may be seen that the tail portion 3 of the clubhead 1 is concentric with longitudinal axis 8, and that neck axis 11 is coincident with and intersects longitudinal axis 8. The distance from sole 4 to longitudinal axis is labeled with distance line X.

Figure 3:
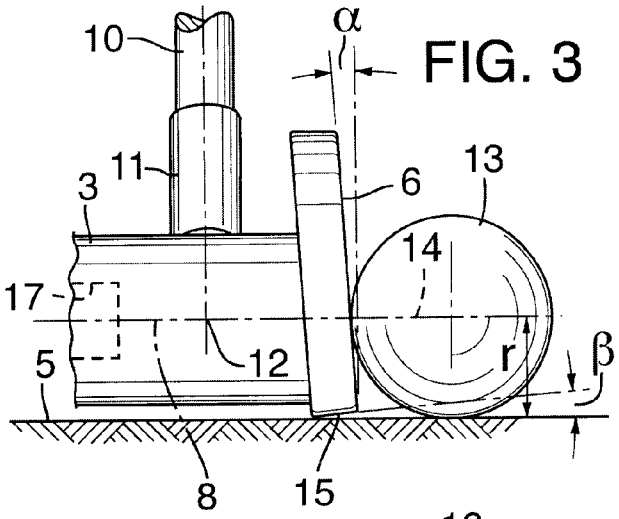
FIG. 3 is a partial fragmentary view of the clubhead taken along the line 3—3 of FIG. 2, showing loft and sole configurations.

With reference to FIG. 3, in which putter clubhead 1 is in a normal putting position for addressing a golf ball 13, it may be seen that the distance X is preferably approximately equal to the radius r of the ball. Accordingly, as the clubhead is swung through a normal stroke with sole 4 moving closely over turf 5, forward-facing surface 6 of ball striking plate 2 makes contact with a point on ball 13 at approximately an equator 14 on the ball. More particularly, a point approximately on an equator 14 of ball 13 makes contact with forward-facing surface 6 at approximately the point at which longitudinal axis 8 intersects the forward-facing surface. The intersection of longitudinal axis 8 with the forward-facing surface 6 thus defines a ball-contacting area in which the center of mass of the clubhead is effectively concentrated and centered. This results in improved directional control during putting.

The mass of ball-striking plate 2 is relatively less than the mass of tail portion 3. Therefore, it will be appreciated that the size of the semi-circle defined by ball-striking plate 2 (FIG. 2) may be increased or decreased without materially altering the concentration of mass of the clubhead. For instance, the size of the ball-striking plate may be decreased to approximately the size of a golf ball. As another example, the ball striking plate 2 could be sized such that it is essentially coextensive with the tail portion 3.

Where desired, the total mass of the clubhead, and so the swing weight of the club, could be varied without significantly effecting the clubhead balance and symmetry. This may be done by removing material, core 17, concentric with the longitudinal axis 8 through tail portion 3. FIGS. 1, 2, 3. Such displaced material could be left as a void or filled with a material dissimilar to the material used to form the clubhead, and of dissimilar density, to attain the desired swing weight.

FIG. 3 also illustrates an embodiment in which, without detracting from the benefits of the symmetry of the clubhead, the forward-facing surface 6 of ball striking plate 2 is tilted slightly relative to longitudinal axis 8 to create loft. Although forward-facing surface 6 is thus tilted relative to longitudinal axis 8, the plane of the forward-facing surface of the clubhead remains substantially normal to longitudinal axis 8. Again, the ball-contacting area, which may be approximated as the point where longitudinal axis 8 intersects forward-facing surface 6, is where the center of mass of the clubhead is effectively concentrated and centered in a normal golf stroke. The tilt of the forward-facing surface 6, referenced with angle a may be varied according to preference. As also shown in FIG. 3, the lowermost edge 15 of sole 4, that is, that portion of sole 4 that lies adjacent turf 5 when the club is in use, may be tilted or beveled slightly to facilitate a smooth putting stroke. The degree of tilt β of lowermost edge 15 is variable according to preference.

Figure 4:
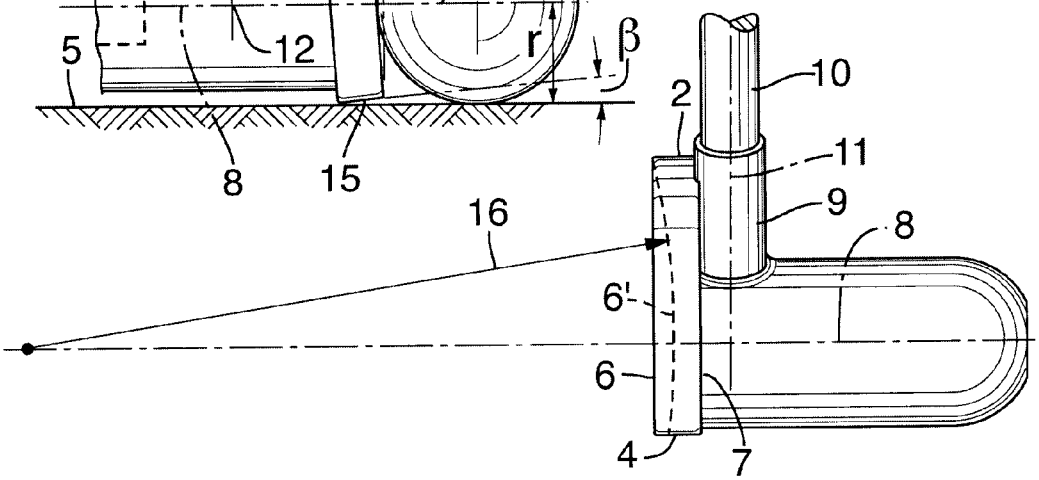
FIG. 4 is a side elevational view of an alternative embodiment of the clubhead showing a radially formed surface in the ball striking face with the radius coincidental with the longitudinal axis of the clubhead, and showing an alternate position for the shaft neck.

FIG. 4 illustrates an alternative embodiment of the clubhead of the present invention wherein neck 9 is positioned closer to ball striking plate 2, while maintaining the coincidence of radial neck axis 11 with the longitudinal axis 8 through tail portion 3.

Golf is a sport that is subject to various golf association rules and regulations. Over the years, innovations that enhance performance in golf equipment have resulted in modifications of the rules, which lead to the benefit of improving the score for those skilled in the art of the sport. For example, rules pertaining to ball and clubhead configuration, face markings, grips and shaft lengths have been revised and updated over the past several years.

In anticipation that further innovation will be embraced by those skilled in the art, yet another preferred embodiment is illustrated in FIG. 4, wherein the forward-facing surface 6' is formed in a regular, laterally extending radial section. Specifically, in one embodiment the forward-facing surface 6' is formed as an arc section of a sphere having a spherical radius 16 having its center on the longitudinal axis 8 of the tail portion 3. Although forward-facing surface 6' thus defines a radial formed surface, the forward-facing surface of the clubhead remains substantially normal to longitudinal axis 8. As with the embodiments of FIGS. 1 and 3, the ball-contacting area, which may be approximated as the point where longitudinal axis 8 intersects forward-facing surface 6', is where the center of mass of the clubhead is effectively concentrated and centered in a normal golf stroke.

Radius 16 could be varied but ideally would correct for mis-hits, off the longitudinal axis 8 on longer putts. The radial surface would thus focus the ball rebound trajectory back to the longitudinal axis 8 at the center point of the radius. Such radius 16 for the formed club face 6' might ideally be about 10 to 20 feet, but may be varied widely. It will be appreciated that where radius 16 is in the preferred range of between about 10 to 20 feet, the radius shown in drawing FIG. 4 is exaggerated for the purposes of illustration.

Although not shown in the Figures, the forward-facing surface 6' of ball-striking plate 2 may be formed as an arc section of a cylinder. The longitudinal axis through such cylindrical arc section would be preferably oriented normal to the plane defined by the lowermost edge 15 of sole 4, and would be positioned such that it intersects with the longitudinal axis 8 of the tail portion 3. The radius could be variable but again ideally would correct for mis-hits, off the longitudinal axis 8 on longer putts, and would focus the ball rebound trajectory back to the clubhead axis at the center point of the radius. Such radius 16 for the radially formed club face 6' might ideally be about 10 to 20 feet.

Certain alternative configurations and structures may be made to the foregoing preferred embodiment without effecting the invention. For example, while the preferred cross sectional shape of tail portion 3 is circular, the tail portion 3 could be formed in other cross sectional configurations, such as triangular or square, while maintaining the center of mass of the clubhead along a longitudinal axis through the tail portion.

It is understood that the above discussion and details of the preferred embodiments and drawings are exemplary of the present invention and that changes in structure and configuration of golf putters may be effected without departing from the scope of the present invention and equivalents as defined in the following claims.

What is claimed is:

1. A golf putter head, comprising:

a ball striking plate having a forward-facing surface for striking a golf ball, said forward-facing surface defining a curved concave surface;

an elongate tail portion extending from said ball striking plate and defining a longitudinal axis extending through said tail portion.

2. The golf putter head according to claim 1 including a shaft neck connected to the elongate tail portion and defining a neck axis that is normal to and radiating from the longitudinal axis of the elongate tail portion, and wherein said neck axis intersects said longitudinal axis.

3. The golf putter head according to claim 2 in which the golf putter head has a center of mass on the longitudinal axis and in which the neck axis intersects the center of mass.

4. The golf putter head according to claim 1 in which the ball striking plate has a flattened sole located parallel to the turf when the putter is in a normal putting position.

5. The golf putter head according to claim 4 in which the distance from the sole to the longitudinal axis through the tail portion is approximately equal to the radius of the golf ball.

6. The golf putter head according to claim 1 in which the intersection of the longitudinal axis through the elongate tail portion with the ball striking plate defines a golf ball contact area, and wherein said ball striking plate is configured to present the golf ball contact area with a golf ball at a position approximately coincident with an equator of said golf ball.

7. The golf putter head according to claim 1 in which the curved concave surface of the ball-striking face defines a spherically curved surface and wherein the center of a sphere defined by said spherically curved surface lies substantially on the longitudinal axis through the tail portion.

8. The golf putter head according to claim 1 in which the curved concave surface of the ball-striking face is defined by a cylindrically curved surface.

9. The golf putter head according to claim 8 in which the longitudinal axis extending through said cylinder is normal to a plane extending along the sole, and wherein the longitudinal axis through said cylinder intersects the longitudinal axis through said tail portion.

10. The golf putter head according to claim 1 in which the elongate tail portion is cylindrical and concentric about said longitudinal axis.

11. A golf putter head comprising:

a golf ball striking surface for contacting a golf ball, said striking surface comprising a regularly curved concave surface;

a tail portion extending from said ball striking surface and having a longitudinal axis extending through said tail portion that is substantially normal to the golf ball striking surface;

a shaft neck connected to the tail portion, said shaft neck having a neck axis that is normal to and radiating from the longitudinal axis extending through said tail portion.

12. The golf putter head according to claim 11 in which the tail portion is cylindrical and concentric about said longitudinal axis, and wherein the golf putter head has a center of mass that lies substantially on the longitudinal axis and the neck axis intersects said longitudinal axis.

13. The golf putter head according to claim 12 in which the ball striking surface has a flattened sole located parallel to the turf when the putter is in a normal putting position, said sole defining a sole plane parallel to the turf.

14. The golf putter head according to claim 13 in which the distance from the sole to the longitudinal axis through the tail portion is approximately equal to the radius of the golf ball.

15. The golf putter head according to claim 11 in which the smoothly curved concave surface of the ball striking surface defines a spherically curved surface, and wherein the center of a sphere defined by said spherically curved surface lies on the longitudinal axis through the tail portion.

16. The golf putter head according to claim 11 in which the regularly curved concave surface of the ball striking surface is defined by a cylindrically curved surface.

17. The golf putter head according to claim 16 in which the longitudinal axis extending through said cylinder is normal to the sole plane, and wherein the longitudinal axis through said cylinder intersects the longitudinal axis through said tail portion.

* * * * *